US008636503B2

(12) United States Patent
Kasprzyk et al.

(10) Patent No.: US 8,636,503 B2
(45) Date of Patent: Jan. 28, 2014

(54) PILOT BURNER

(75) Inventors: Donald J. Kasprzyk, Maple Grove, MN (US); Sybrandus B. V. Munsterhuis, Dalen (NL)

(73) Assignee: Honeywell International Inc., Morristown, NJ (US)

( * ) Notice: Subject to any disclaimer, the term of this patent is extended or adjusted under 35 U.S.C. 154(b) by 1212 days.

(21) Appl. No.: 12/174,581

(22) Filed: Jul. 16, 2008

(65) Prior Publication Data

US 2010/0015560 A1 Jan. 21, 2010

(51) Int. Cl.
*F23Q 9/00* (2006.01)

(52) U.S. Cl.
USPC ..... 431/278; 431/194; 431/196; 431/354; 29/428; 137/599.01

(58) Field of Classification Search
USPC ..... 431/278, 194, 196, 80, 354, 79; 29/428; 137/599.01; 248/65, 75, 300
See application file for complete search history.

(56) References Cited

U.S. PATENT DOCUMENTS

| | | | | |
|---|---|---|---|---|
| 2,609,870 | A | 9/1952 | Riebman et al. | |
| 2,884,009 | A * | 4/1959 | Hetherington | 138/46 |
| 3,052,286 | A | 9/1962 | Kramer et al. | |
| 3,056,450 | A * | 10/1962 | Loveland et al. | 431/80 |
| 3,620,849 | A * | 11/1971 | Thompson | 136/217 |
| 3,825,183 | A | 7/1974 | Machlanski | |
| 4,165,963 | A | 8/1979 | Nozaki | |
| 4,177,034 | A * | 12/1979 | Jones | 431/264 |
| 4,565,521 | A | 1/1986 | Hancock | |
| 5,039,300 | A * | 8/1991 | Riehl | 431/354 |
| 5,163,830 | A | 11/1992 | Pfefferkorn | |
| 6,056,540 | A * | 5/2000 | Newman et al. | 431/264 |
| 6,547,277 | B1 * | 4/2003 | Adamini et al. | 280/741 |
| 7,300,278 | B2 | 11/2007 | Vandrak et al. | |

FOREIGN PATENT DOCUMENTS

| | | |
|---|---|---|
| GB | 207311 | 11/1923 |
| GB | 956326 | 4/1964 |

OTHER PUBLICATIONS

Description of Honeywell Q5000 Water Heater Pilot Hardware, at least as early as Jul. 16, 2007, 10 pages.

* cited by examiner

*Primary Examiner* — Avinash Savani
(74) *Attorney, Agent, or Firm* — Seager Tufte & Wickhem LLC.

(57) ABSTRACT

An improved pilot burner includes an orifice plate defining a central orifice for metering a supply of gas and a gas tube. The gas tube includes a tube wall and defines a supply opening at a first end. The orifice plate is positioned within the gas tube at the supply opening, and the tube wall is crimped around the orifice plate to secure the orifice plate to the gas tube. The pilot burner also includes a burner tube having a first end for receiving a first end of the gas tube. The burner tube further includes a second end defining a flame opening. In another embodiment, a clip is used to secure the gas tube and the burner tube to a bracket.

19 Claims, 8 Drawing Sheets

PILOT BURNER

FIELD OF THE INVENTION

The invention relates to gas-fired burner configurations, including pilot burner configurations, which are especially useful in the context of gas-fired appliances such as water heaters.

BACKGROUND OF THE INVENTION

Gas-fired appliances that cycle on and off can have a pilot burner which provides a flame whose purpose is to light the main burner when there is a call for heat. Another purpose of the pilot burner is to provide a safety control mechanism which ensures that if the pilot flame is extinguished for any reason, then the supply of gas to the whole appliance is cut off.

Pilot burners for gas-fired appliances typically include a pilot burner tube which defines a flame opening at one end. At the opposite end of the pilot burner tube, there are structures which attach the pilot burner tube to a supply of gas such as a gas tube. The pilot burner tube is connected to the gas tube to make a gas-tight seal. In many devices, a ferrule and nut are used to make the gastight seal. However, in such a configuration, there are often two distinct seal areas and sometimes more than two seal areas where parts connect so that a seal is required to isolate the gas supply from the ambient atmosphere. In a common configuration, two distinct seal areas are located (1) between the burner tube and the ferrule, and (2) between the orifice and the ferrule. Very high temperatures are involved in the combustion chamber and the gas-tightness of the seal areas are areas of concern. Also, a reduction in the total number of parts and complexity of parts is desirable. Improved constructions for pilot burners are desired. In particular, improved constructions for pilot burners are desired that require fewer sealing junctures between parts, use fewer parts, and use parts that are easier to manufacture.

SUMMARY OF THE INVENTION

Embodiments of the invention are related to burner systems and methods that can be used in gas-fired devices. In one embodiment, an improved pilot burner includes an orifice plate defining a central orifice for metering a supply of gas and a gas tube. The gas tube includes a tube wall and defines a supply opening at a first end. The orifice plate is positioned within the gas tube at the supply opening, and the tube wall is crimped around the orifice plate to secure the orifice plate to the gas tube. The pilot burner also includes a burner tube having a first end for receiving a first end of the gas tube. The burner tube further includes a second end defining a flame opening.

In another embodiment, an improved pilot burner includes a gas tube including a tube wall and defining a supply opening at a first end. An orifice plate is positioned at the supply opening. The pilot burner further includes a burner tube having a first end for receiving a first end of the gas tube and a second end defining a flame opening, in addition to a bracket configured to hold the gas tube and burner tube in stable positions. The bracket defines a first opening and a second opening, wherein the first opening and the second opening are aligned and spaced from each other. The pilot burner further includes a clip configured to secure the burner tube and gas tube to the bracket so that a portion of the burner tube extends from the first opening of the bracket.

In another embodiment of the invention, a method of assembling a pilot burner includes providing a gas tube comprising a tube wall and defining a supply opening at a first end, where an orifice plate is positioned at the supply opening. Another step is positioning a tube holder to be surrounding the gas tube at the first end of the gas tube, wherein the orifice plate is positioned at a first end of the tube holder. Yet another step is placing a burner tube over the first end of the tube holder and the first end of the gas tube to form a burner tube assembly. The burner tube has a first flared end for receiving a first end of the gas tube and a first end of the tube holder. The burner tube has a second end defining a flame opening. Another step is inserting the burner tube assembly into at least one opening of a bracket.

The invention may be more completely understood by considering the detailed description of various embodiments of the invention that follows in connection with the accompanying drawings.

Figure 1:
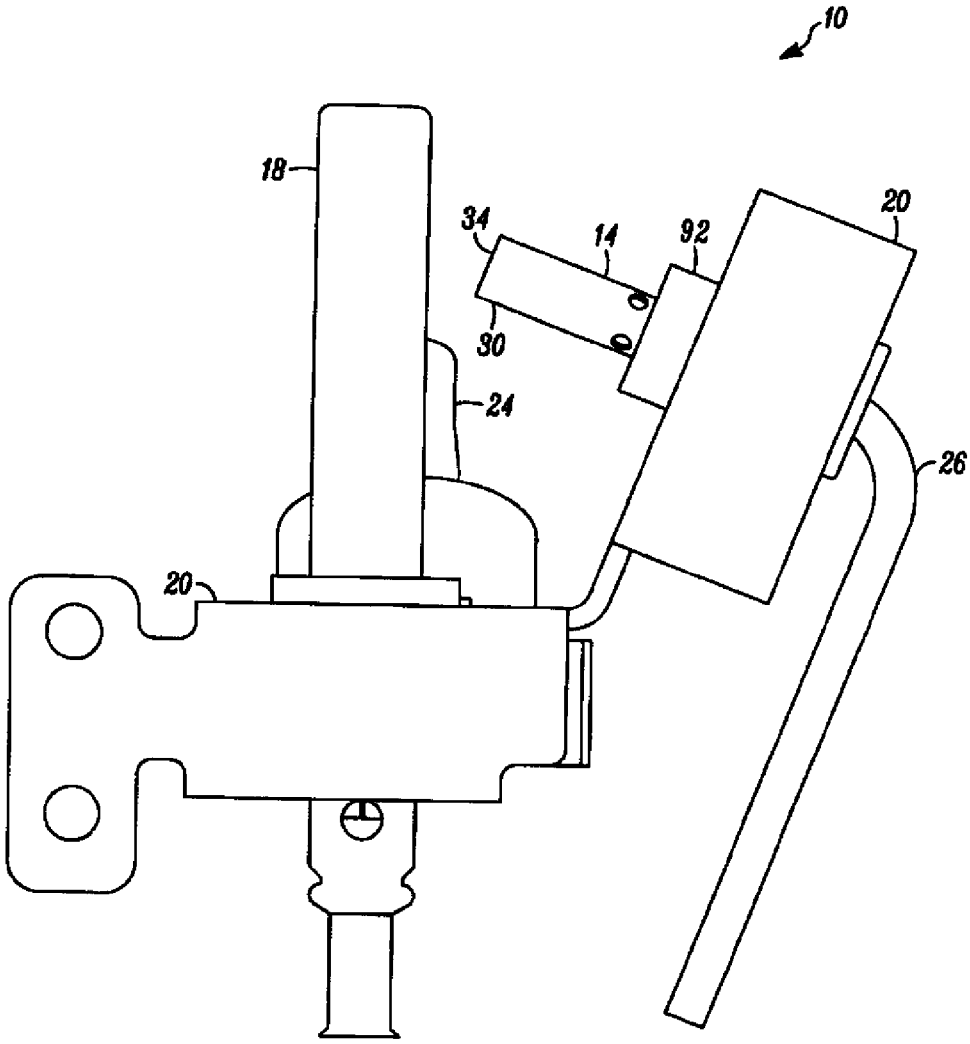
FIG. 1 is a top view of a pilot burner according to one embodiment.

While the invention may be modified in many ways, specifics have been shown by way of example in the drawings and will be described in detail. It should be understood, however, that the intention is not to limit the invention to the particular embodiments described. On the contrary, the intention is to cover all modifications, equivalents, and alternatives following within the scope and spirit of the invention as defined by the claims.

DETAILED DESCRIPTION OF THE INVENTION

This application relates to a burner configuration, and more particularly to a pilot burner configuration that reduces the number of areas that require a gas-tight seal. More particularly, certain embodiments of the pilot burner configuration described herein have only one gas-tight seal in the pilot burner assembly.

A pilot burner includes components that connect a source of gas, such as a gas tube, to a burner tube. The burner tube, when connected to a source of gas at a first end and having a spark source at the second end, will produce a single open gas flame at a flame opening at one end.

In one embodiment, an orifice plate is press-fit into the end of the gas tube, and this is the only gas-tight sealing connection that is required in the pilot burner assembly. In one embodiment, a mechanical clip having a spring action is used to secure the gas tube and burner tube to a bracket, so that the parts are held securely in place.

FIG. 1 is a top view of one embodiment of a pilot burner 10 of the present invention. The pilot burner 10 includes a burner tube 14, a thermopile 18 and a bracket 20 which holds the burner tube 14. The burner tube 14 defines a flame opening 34 at the end that is closest to the thermopile. A gas tube 26 provides a supply of gas to the burner tube 14. The pilot burner 10 can also include a spark source 24 held in position by the bracket. The bracket and the spark source will both be described in more detailed later herein.

A thermopile is a device that converts thermal energy into electrical energy. It is composed of thermocouples either connected in series or in parallel. For the pilot burner 10, it is possible for a single thermocouple to be used instead of a thermopile, but it is more common for a collection of thermocouples such as a thermopile to be used with a pilot burner. When a flame is present at a flame opening 34 of the burner tube, the flame or heat from the flame is directed to the body of the thermopile 18. As a result, the thermopile 18 generates a current. The current is directed to a control mechanism such as a valve upstream on the gas line, configured so that the current holds the valve in an open position. If the flame of the pilot burner is extinguished, then the current from the thermopile ceases and the gas valve to the pilot burner and main burner will close. In this way, the pilot burner provides a safety mechanism.

Figure 2:
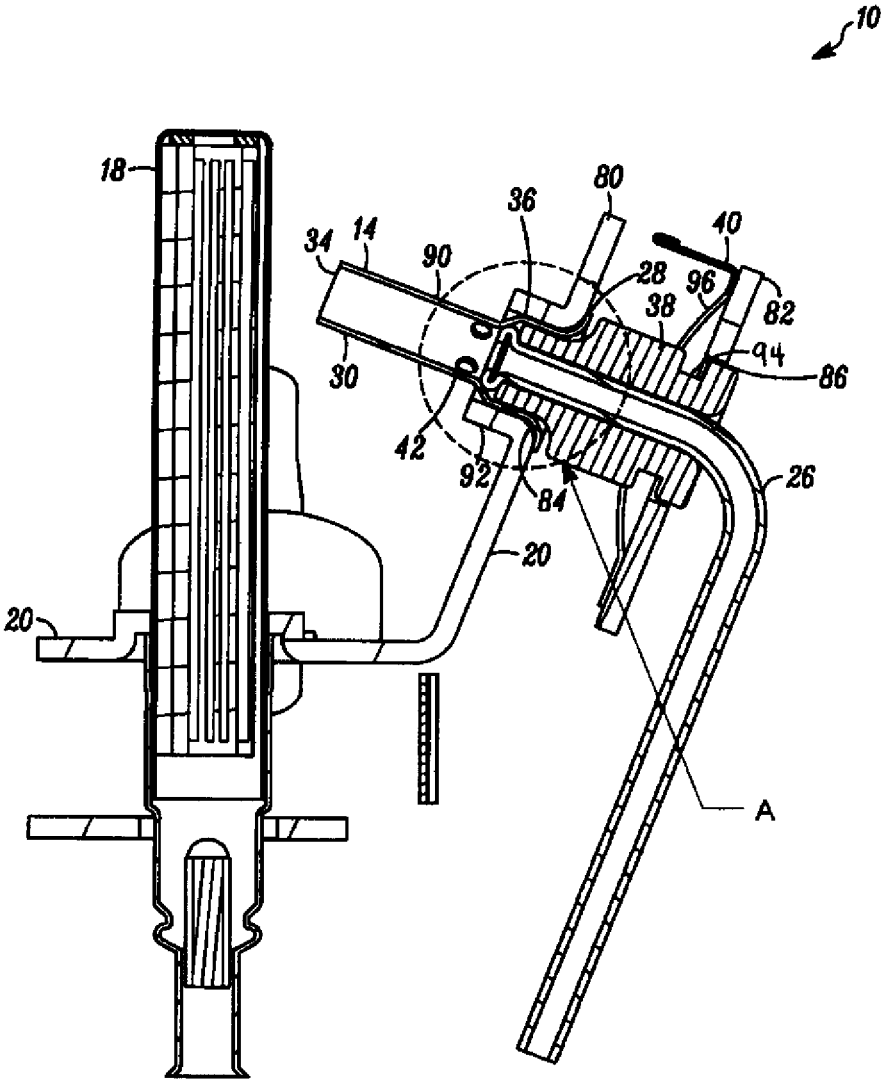
FIG. 2 is a cross-sectional view of the pilot burner of FIG. 1, where the section is taken through a burner tube and a thermopile.

FIG. 2 is a cross-sectional view of the pilot burner 10 of FIG. 1, where the section is taken through the center of the burner tube 14 and the thermopile 18. The burner tube 14 has first end 28 that is positioned within an opening in the bracket 20, and a second end 30 that defines a flame opening 34. The burner tube 14 defines a flared portion 36 adjacent to its first end 28. The flared portion receives the gas tube 26. The flared portion 36 also receives a tube holder 38 which serves to center the gas tube 26 within the flared portion, and serves to secure the gas tube to the bracket via a clip 40, as will be discussed in more detail herein. The flared portion 36 of the burner tube 14 defines a number of air inlet openings 42 which serve to allow ambient air to enter the burner tube and mix with the gas from the gas tube. Detail portion A of FIG. 2 is shown using a larger scale in FIG. 3, and includes the flared portion 36.

Figure 4:
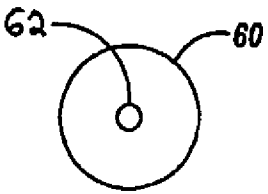
FIG. 4 is top view of an orifice plate of the pilot assembly of FIG. 1.
Figure 3:
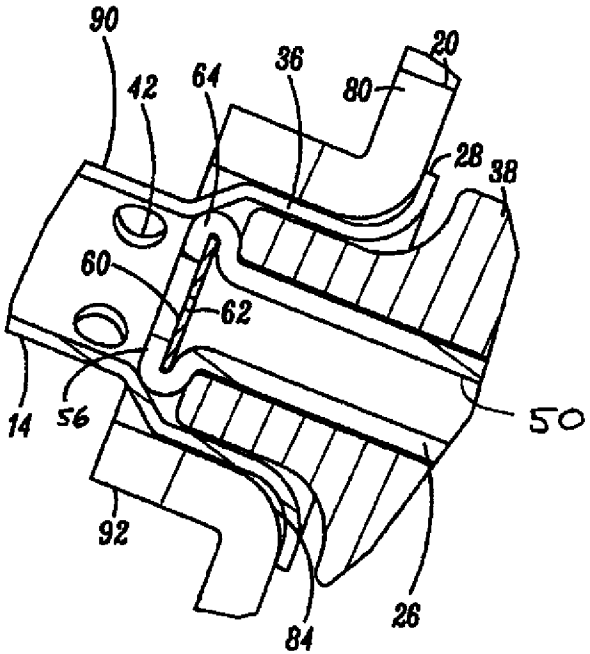
FIG. 3 is a cross-sectional view of detail area A of FIG. 2.

Now referring to FIG. 3, the gas tube 26 includes a tube wall 50 extending along its length. The gas tube 26 also includes a supply opening at a first end 56. The gas tube 26 is connected at its opposite end to a source of gas, which is not shown. Received within the first end 56 is a structure that defines an orifice, which will be referred to as an orifice structure. The orifice structure may be an orifice plate 60. The orifice plate 60 is also shown alone in a top view in FIG. 4, and defines a central orifice 62 for permitting a flow of gas into the burner tube 14. In one embodiment, the orifice plate 60 is a flat disk having a thickness of at least 5 thousandths of an inch and no more than 20 thousandths of an inch, or in another embodiment at least 7 thousandths of an inch and no more than 8 thousandths of an inch. The orifice plate is metal in one embodiment, such as stainless steel.

Referring again to FIG. 3, the gas tube 26 is made of a durable and typically somewhat flexible material, such as aluminum. In one example, the gas tube diameter is ⅛ inch and the tube wall thickness is about 32 thousandths of an inch. The orifice plate 60 is press-fit into place at the first end of the gas tube 26 and the tube wall material is crimped or fitted around a circumference of the orifice plate. To accomplish this press-fit, the following steps are performed. First, the tube wall 50 at the tube end 56 is expanded in diameter, such as by pushing a piece of metal into the end. Then the orifice plate 60 is placed in the expanded tube end. The tube wall is rolled over the orifice edge and is staked tight to the orifice plate outer surface, by applying pressure against the tube wall end to push it against the orifice plate. As a result, the tube wall 50 at the tube end 56 is pushed against and sealed to the circumference of the orifice plate as well as to the two major surfaces of the orifice plate.

The press-fit process provides a gas-tight seal around a circumference of the orifice plate 60 and between the two major surfaces and the gas tube wall. When the orifice plate 60 is in place, the gas tube 26 outer wall defines an orifice flange 64 where the outer diameter of the gas tube is larger than for the remainder of the gas tube.

The pilot burner described herein is configured to minimize the number of gas-tight sealing interfaces that must be accomplished. In the embodiment show in FIGS. 1-3, the only gas-tight seal that is required is the seal between the gas tube wall and the orifice plate. Because the gas tube and the orifice plate are positioned within the flared end of the burner tube, no other gas-tight seals are required. In addition, fewer parts are used compared to prior art configurations and the parts are simple and economical to manufacture.

Figure 5:
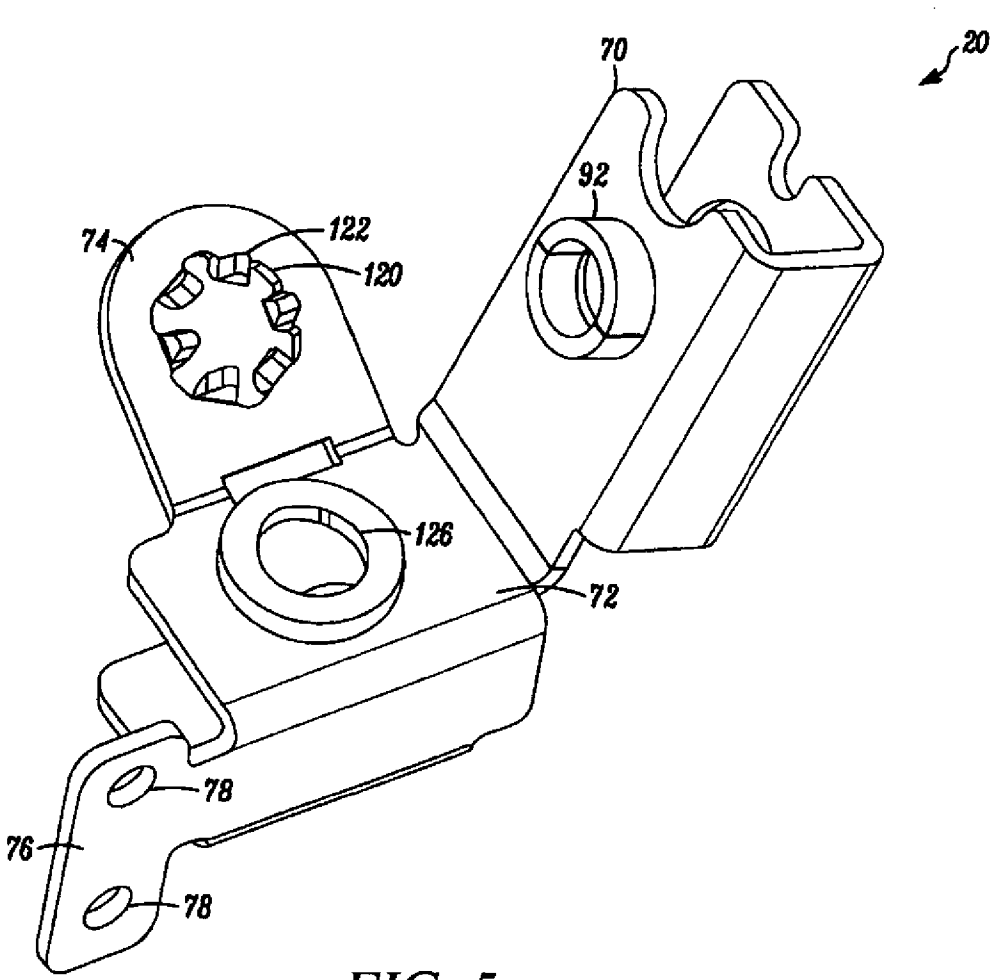
FIG. 5 is a top and side perspective view of a bracket of the pilot burner of FIG. 1.

Now the configuration of the bracket 20 will be described, along with the mating structures present on other components that allow securing those components to the bracket. FIG. 5 is a top and side perspective view of the bracket 20. The bracket 20 includes a first portion 70 for mounting a burner tube, a second portion 72 for mounting a thermopile, and a third portion 74 for mounting a spark source. In addition, the bracket includes a fourth portion 76 which defines openings 78 for mounting the bracket 20 itself to another structure, such as to a gas-fired appliance.

Figure 6:
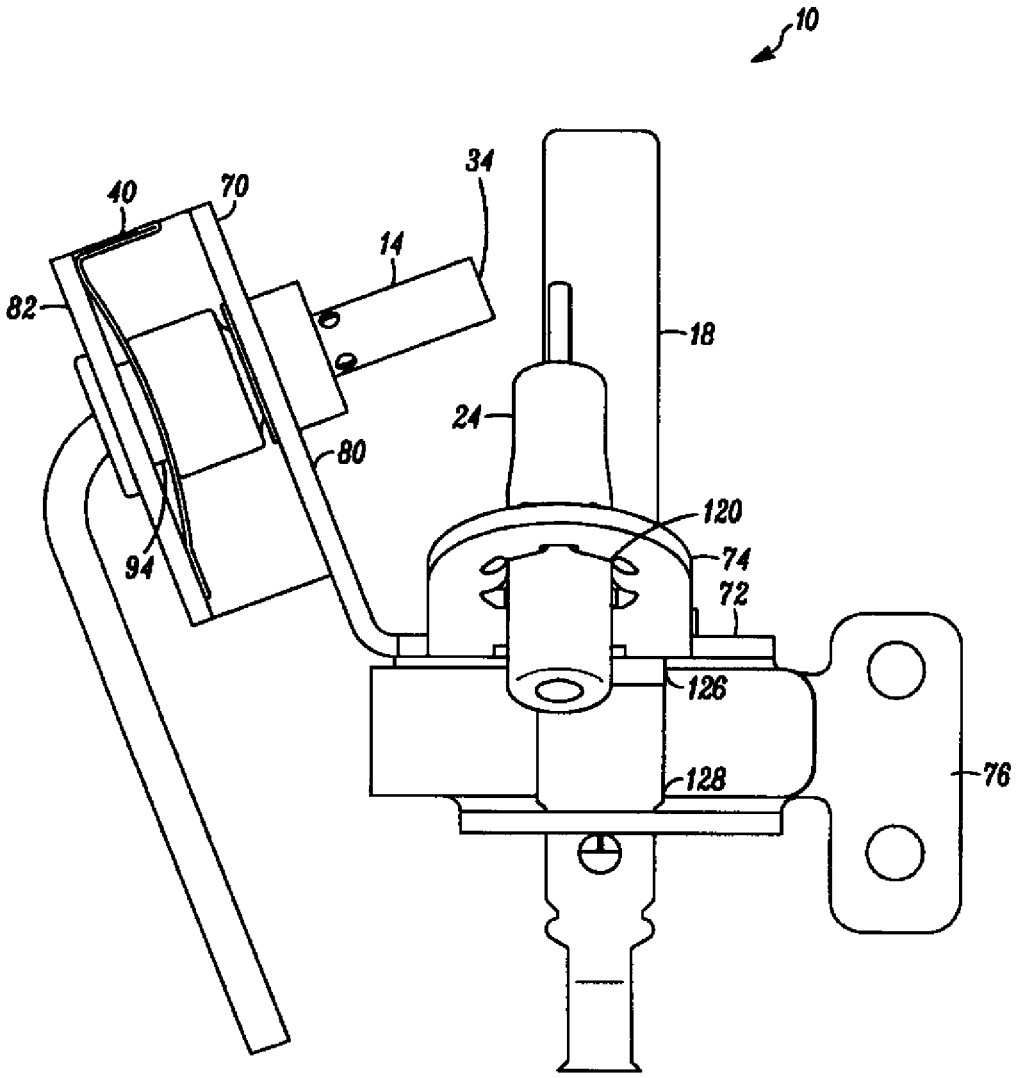
FIG. 6 is a bottom view of the pilot burner of FIG. 1.

The first, second and third portions 70, 72, 74 of the bracket 20 each include planar elements that are angled toward each other. The angles of the planar elements of the first, second and third portions 70, 72 and 74 are configured so that the area above the flame opening of the burner tube 14 will be very close to the end of the spark source 24 and the body of the thermopile 18, as can be seen in FIGS. 1 and 6. FIG. 6 is a bottom view of the pilot burner 10.

Figure 7:
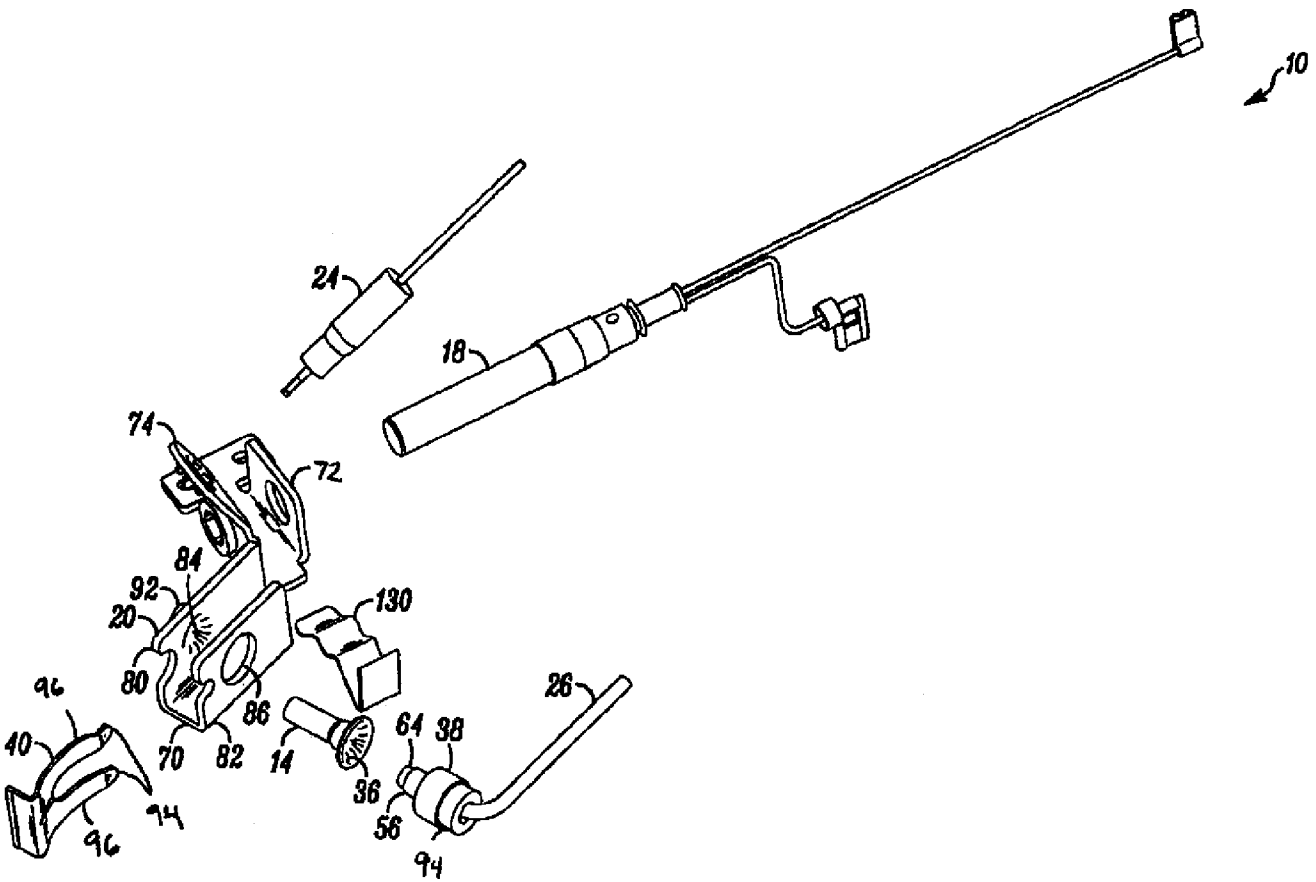
FIG. 7 is an exploded perspective view of the components of the pilot burner of FIG.

Now referring to FIG. 7, which is an exploded view of the elements of the pilot burner 10, it can be seen that the burner tube portion 70 of the bracket includes two plates 80, 82 that are parallel to each other, each with an opening 84, 86, where the two openings 84, 86 are aligned with each other. To secure the gas tube and burner tube 14 to the bracket 20, the tube holder 38 is placed on the gas tube 26 and moved into position so that the tube holder 38 is near the first end 56 of the gas tube 26. As can be seen in the cross-sectional view of FIG. 9, the tube holder 38 defines a passage 88 in which the gas tube 26 is positioned. Now referring to FIG. 3, the flange 64 of the gas tube 26 is at the top of the tube holder 38.

Figure 9:
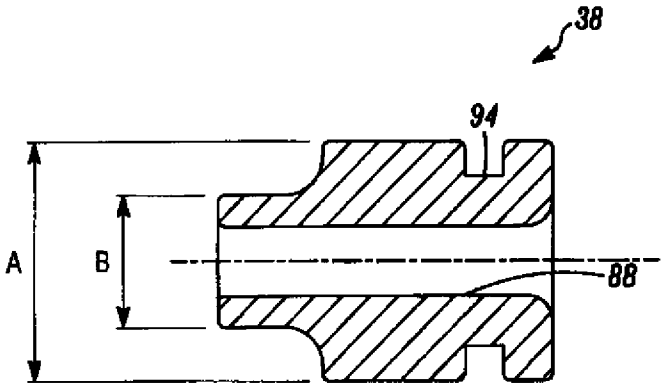
FIGS. 8 & 9 are a side view and a cross sectional view, respectively, of a tube holder of the pilot burner of FIG. 1.

Referring again to FIG. 7, the assembly of the burner tube 14 and gas tube 26 to the bracket 20 will now be described. As mentioned above, the tube holder 38 is positioned at the first end 56 of the gas tube 26, so that only the orifice flange 64 of the gas tube 26 is extending from the end of the tube holder 38. The burner tube 14 is positioned so that the flared portion 36 covers the orifice flange 64. The burner tube 14, gas tube 26 and tube holder 38 form a burner tube assembly that is passed through the opening 86 of the second plate 82. To allow this assembly process, the maximum outer diameter of the tube holder (as shown in FIG. 9) is smaller than the inner diameter of the second opening 86.

Part of the burner tube assembly also passes through the opening 84 in the first plate 80, including a straight portion 90 of the burner tube 14, as seen in FIGS. 2-3. A cylindrical lip 92 of the bracket 20 extends away from the first plate 80 and surrounds the flared portion 36 and the gas tube and tube holder within the flared portion 36. The air inlet openings 42 of the burner tube are clear of the lip 92 so that they are not blocked by the lip. Most of the tube holder 38 is positioned between the first and second plates 80, 82, with a groove 94 (FIG. 8) of the tube holder being positioned so that it is between the second plate 82 and the first plate 80.

Referring again to FIG. 7, the clip 40 is then slid into the groove 94 of the tube holder 38 to hold the tube holder 38 in place on the bracket. The clip 40 includes two curved extensions 96, where each extension 96 has a leading edge 98. As the two extensions 96 are slid into the groove 94 of the tube holder, the clip 40 presses the tube holder toward the first plate 80 of the bracket 20. As the clip 40 presses the tube holder toward the first plate 80 of the bracket, the curve of the curved extensions are somewhat flattened. The side view of FIG. 6 shows the clip slightly flattened between the groove 94 and the second plate 82. The spring force of the curved extensions 96 holds the tube holder, and thereby the gas tube and tube burner, tightly in position. In one embodiment, the clip 40 is made of a metal, such as stainless steel.

FIG. 2 also shows a side view of one of the curved extensions 96 of the clip 40. In FIG. 2, the curved extension 96 is shown in its unstressed position, with a curve that arcs above the level of the groove 94. This view illustrates the unstressed shape of clip 40, but in reality the curved extensions would be in the slightly flattered configuration shown in FIG. 7 when the clip is in placed in the bracket, because the curved extension 96 would be in contact with one edge of the groove 94.

Figure 8:
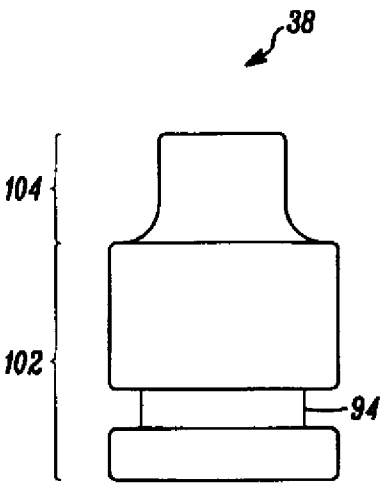

FIGS. 8 and 9 are side and cross-sectional views of the tube holder 38, respectively. The tube holder defines a passage 88 for receiving the gas tube. The tube holder also defines a groove 94 in which the clip 40 is received. A first portion 102 of the tube holder 38 has a first outer diameter A. A second portion 104 of the tube holder narrows to a second, smaller outer diameter B. The second smaller diameter B is smaller than the inner diameter of the first opening 84, and the difference between these two diameters accommodates the flared portion 36 of the burner tube 14.

Figure 10:
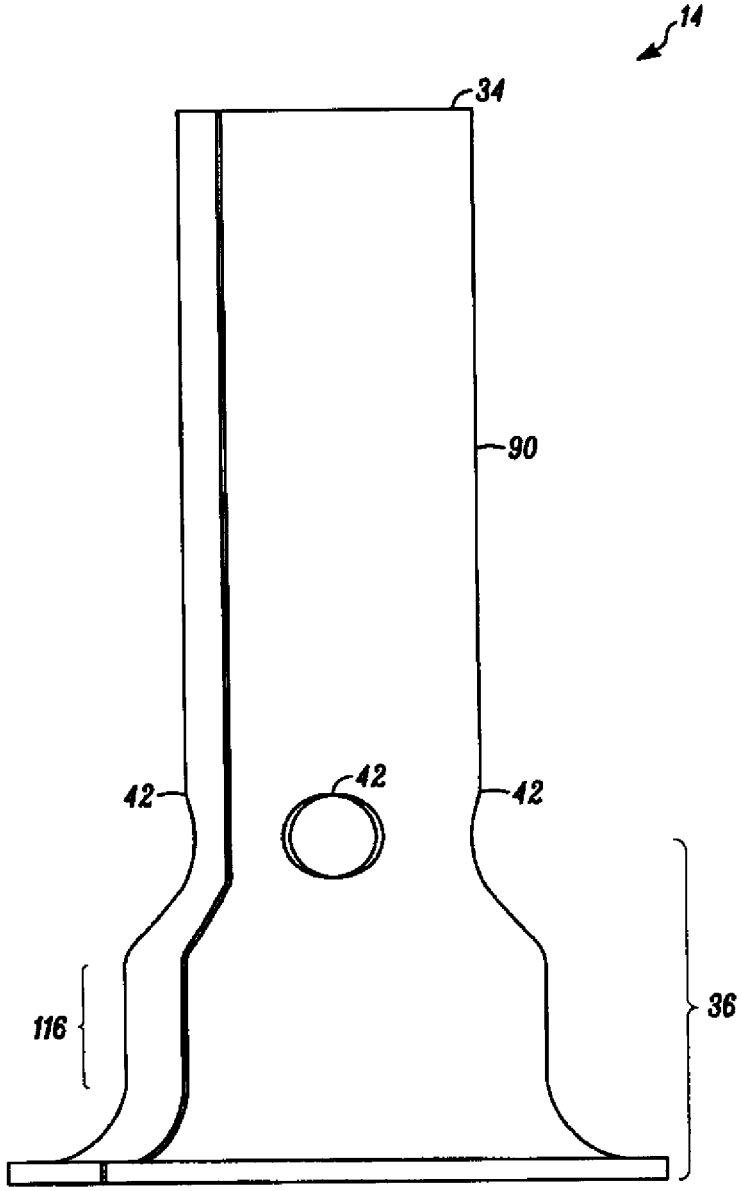
FIG. 10 is a side view of a burner tube of the pilot burner of FIG. 1.

FIG. 10 is a side view of the burner tube 14, which includes a flame opening 34, air inlet openings 42, straight portion 90 and flared portion 36. The flared portion 36 includes a second straight portion 116. In one embodiment, the inner diameter of the second straight portion 116 of the burner tube 14 is just slightly greater than the outer diameter B of the tube holder 38, as can be best seen in FIG. 2.

Now referring to FIGS. 5 and 6, the spark source 24 and thermopile 18 are also held in position by the bracket 20. The spark source 24 passes through a spark source opening 120 in the third portion 74 of the bracket 20. Protrusions 122 help to ensure that the spark source stays in the desired position, so that the end of the spark source is in the flame area. In one example, the flame area is within about 150 thousandths of an inch from the flame opening. The thermopile 18 is received in a first thermopile opening 126 and a second thermopile opening 128 that are defined within the second portion 72 of the bracket 20. A thermopile clip 130, seen in FIG. 7, slides alongside the thermopile and secures it in place in the bracket 20. One example of a thermopile that can be used with the pilot burner is Model No. Q2313 available from Honeywell of Golden Valley, Minn. One example of a spark source that can be used with the pilot burner is a piezoelectric sparker or other type of sparker.

The present invention should not be considered limited to the particular examples described above, but rather should be understood to cover all aspects of the invention as fairly set out in the attached claims. Various modifications, equivalent processes, as well as numerous structures to which the present invention may be applicable will be readily apparent to those of skill in the art to which the present invention is directed upon review of the present specification. The claims are intended to cover such modifications and devices.

The above specification provides a complete description of the structure and use of the invention. Since many of the embodiments of the invention can be made without parting from the spirit and scope of the invention, the invention resides in the claims.

What is claimed is:

1. An improved pilot burner comprising:

an orifice plate defining a central orifice for metering a supply of gas;

a gas tube comprising a tube wall and defining a supply opening at a first end, wherein the orifice plate is positioned within the gas tube at the supply opening, wherein the tube wall is crimped around the orifice plate such that the tube wall is sealed to a circumference, a first side, and a second side of the orifice plate to secure the orifice plate to the gas tube at the first end of the gas tube;

a burner tube having a first end for receiving the first end of the gas tube, the burner tube further comprising a second end defining a flame opening;

a bracket configured to help hold the gas tube and burner tube in stable positions relative to one another, wherein the bracket defines a first opening and a second opening, wherein the first opening and the second opening are aligned along a common axis and spaced from each other, and wherein the bracket holds the first end of the gas tube adjacent to the first opening of the bracket, and the gas tube extends through the second opening of the bracket;

wherein the gas tube has a uniform inner diameter from a location adjacent to the orifice plate to at least a location adjacent to the second opening of the bracket; and wherein the bracket further including a second bracket portion angularly connected to the bracket wherein the second bracket portion has a plate extension.

2. The improved pilot burner of claim 1 further comprising a clip that is slidably received in a portion of the bracket, wherein the clip is configured to help hold the gas tube and burner tube to the bracket.

3. The improved pilot burner of claim 1, further comprising a tube holder surrounding the gas tube near its first end and sized to pass through the second opening of the bracket.

4. The improved pilot burner of claim 3, wherein the tube holder defines a base groove, the pilot burner further comprising a clip having at least one extension, wherein the extension is configured to be slid along the groove of the tube holder, whereby the clip holds the tube holder and thereby secures the burner tube and gas tube to the bracket.

5. The improved pilot burner of claim 2 wherein the clip includes at least one curved metal portion.

6. The improved pilot burner of claim 1 further comprising:

a spark source, wherein the spark source fits into a spark source opening on the plate extension of the second bracket portion and is positioned to direct a spark at the flame opening of the burner tube.

7. The improved pilot burner of claim 1 further comprising:

a thermocouple, wherein the second bracket portion of the bracket holds the thermocouple in a stable position and wherein a flame at the flame opening will be directed to the thermocouple.

8. The improved pilot burner of claim 1 wherein the gas tube comprises an orifice flange at a location of the orifice plate, where the diameter of the orifice flange is larger than the remainder of the gas tube.

9. An improved pilot burner comprising:

a gas tube comprising a tube wall and defining a supply opening at a first end, wherein an orifice plate is positioned at the supply opening;

a burner tube having a first end for receiving a first end of the gas tube and a second end defining a flame opening;

a bracket configured to help hold the gas tube and burner tube in stable positions, wherein the bracket includes a first plate defining a first opening and a second plate spaced a distance from the first plate, the second plate defining a second opening, wherein the first opening and the second opening are aligned along a common axis and spaced from each other, the bracket further including a second bracket portion angularly connected to the bracket wherein the second bracket portion has a plate extension;

a clip configured to help secure the burner tube and gas tube to the bracket so that a portion of the burner tube extends from the first opening of the bracket; and wherein the clip exerts a spring force on the gas tube.

10. The improved pilot burner of claim 9, further comprising a tube holder surrounding the gas tube near its first end and sized to pass through the second opening of the bracket.

11. The improved pilot burner of claim 10 wherein the tube holder defines a groove and the groove is configured to receive a portion of the clip.

12. The improved pilot burner of claim 11 wherein the clip has two curved extensions, wherein the two curved extensions are configured to be slid along the groove of the tube holder, whereby the clip applies the spring force to the tube holder and thereby secures the tube holder and gas tube to the bracket.

13. The improved pilot burner of claim 9 further comprising:

a spark source, wherein the spark source fits into a spark source opening on the plate extension of the second bracket portion and is positioned to direct a spark at the flame opening of the burner tube.

14. The improved pilot burner of claim 9 further comprising:

a thermocouple, wherein the second bracket portion of the bracket holds the thermocouple in a stable position and wherein a flame at the flame opening will be directed to the thermocouple.

15. The improved pilot burner of claim 9 wherein the gas tube passes through at least the second opening and has a uniform inner diameter from a location adjacent to the orifice plate to at least a location adjacent to the second opening of the bracket.

16. A method of assembling a pilot burner, comprising providing a gas tube comprising a tube wall and defining a supply opening at a first end, wherein an orifice plate is positioned at the supply opening;

positioning a tube holder to surround the gas tube at the first end of the gas tube;

placing a burner tube over the first end of the tube holder and the first end of the gas tube to form a burner tube assembly, wherein the burner tube has a first flared end for receiving a first end of the gas tube and a first end of the tube holder, wherein the burner tube has a second end defining a flame opening;

inserting the burner tube assembly into at least one opening of a bracket; and inserting a clip between a portion of the bracket and a portion of the tube holder to hold the gas tube and burner tube in stable positions;

wherein the clip exerts a spring force on the tube holder and presses the burner tube assembly toward the bracket; and wherein the bracket further includes a second bracket portion angularly connected to the bracket wherein the second bracket portion has a plate extension.

17. The improved pilot burner of claim 10, wherein the burner tube further comprises a flared portion disposed between the first end and the second end of the burner tube.

18. The improved pilot burner pilot of claim 17, wherein a first end of the tube holder is received within the flared portion of the burner tube.

19. The improved pilot burner of claim 9, wherein the first opening in the bracket further comprises a cylindrical lip.

* * * * *